US006779907B2

(12) United States Patent
Beadle

(10) Patent No.: US 6,779,907 B2
(45) Date of Patent: Aug. 24, 2004

(54) RECESSED WALL-MOUNTED LIGHT FIXTURE

(76) Inventor: Joshua Z. Beadle, 5362 Caminito Vista Lujo, San Diego, CA (US) 92130

( * ) Notice: Subject to any disclaimer, the term of this patent is extended or adjusted under 35 U.S.C. 154(b) by 0 days.

(21) Appl. No.: 10/327,269

(22) Filed: Dec. 20, 2002

(65) Prior Publication Data

US 2004/0120141 A1 Jun. 24, 2004

(51) Int. Cl.[7] ..... F21S 8/02
(52) U.S. Cl. ..... 362/145; 362/364
(58) Field of Search ..... 362/145, 147, 362/148, 153.1, 364, 365, 373, 374, 375

(56) References Cited

U.S. PATENT DOCUMENTS 3,530,330 A * 9/1970 Dupree ..... 313/318.03
4,290,094 A 9/1981 Jensen
4,471,416 A 9/1984 Druffel
4,539,629 A * 9/1985 Poppenheimer ..... 362/267
4,760,510 A 7/1988 Lahti
5,222,800 A 6/1993 Chan et al.
5,738,700 A * 4/1998 King ..... 55/385.3
6,431,723 B1 8/2002 Schubert et al.
6,491,407 B1 12/2002 Beadle
2003/0057302 A1 * 3/2003 Swan ..... 239/597
2003/0170442 A1 * 9/2003 Kaminsky et al. ..... 428/315.5

* cited by examiner

*Primary Examiner*—Alan Cariaso
*Assistant Examiner*—Mark Tsidulko
(74) *Attorney, Agent, or Firm*—Procopio, Cory, Hargreaves & Savitch

(57) ABSTRACT

The recessed wall-mounted light fixture assembly has a hollow mounting sleeve which is inserted horizontally in the wall, a lamp housing for enclosing and retaining a lamp, where the lamp housing is adapted to slide and rotate within the mounting sleeve, a face plate with a hood attached to the housing for directing light downward and preventing direct view of the lamp and a lens disposed within the face plate. The lamp is plugged into a socket mounted on a bracket that provides upward and downward adjustability. The lens has two different sections: an upper section which is frosted to diffuse light and a lower section that is clear for maximum transmission of light.

21 Claims, 3 Drawing Sheets

RECESSED WALL-MOUNTED LIGHT FIXTURE

FIELD OF THE INVENTION

The invention is directed generally to an electrical light fixture, and more particularly, to a recessed light fixture which is wall-mounted to provide down-lighting.

BACKGROUND

Recessed wall-mounted light fixtures are commonly used in environmental lighting systems to illuminate walking surfaces adjacent a vertical surface. Such fixtures can be positioned to enhance safety in dark or shadowed areas and are particularly helpful for use near stairs or uneven surfaces where a pedestrian might be unaware of a step-off or edge that can trip him or her. Stairs and other uneven surfaces tend to create shadows when a light source is above the viewer's eye level shining down on the walking surface. These shadows can interfere with depth perception, creating a misimpression as to the depth of the step, which causes the pedestrian to incorrectly place his or her foot, resulting in a stumble or fall. This problem can be exacerbated by placing a bright light at a height that can temporarily blind the person as he or she looks upward while ascending the stairs.

A solution to the foregoing problem is provided by positioning recessed fixtures in the vertical wall at a height above the walking surface but well below the viewer's eye level. However, a disadvantage of such an installation is that, because of the relatively short distance between the light source and the illuminated surface, the beam spread is limited and a number of fixtures are needed to illuminate an entire surface such as a flight of stairs. Installation of a large number of fixtures can be problematic, particularly in a brick, concrete or stone wall. In addition, typical wall-mounted lights have a metal mounting box that is cast or permanently affixed into the wall. These metal boxes are primarily formed from steel and aluminum which can corrode from alkali that leaches out of the concrete or mortar. If the fixture fails and needs to be replaced, the box must be chipped out of the concrete.

Another drawback of existing wall-mounted fixtures is that the light source, i.e., the lamp within the fixture, is positioned at a fixed height and depth within the fixture, such that there is no provision made for variation of the beam spread and projection distance to optimize light distribution.

The need remains for a recessed wall-mounted light fixture that is easily installed and removed, resistant to corrosion and adjustable to optimize light distribution. The present invention is directed to such a need.

SUMMARY OF THE INVENTION

In an exemplary embodiment, a recessed light fixture assembly comprises a hollow mounting sleeve, a lamp housing for enclosing and retaining a lamp, wherein the lamp housing is adapted to slide and rotate within the mounting sleeve for installation and adjustment, a face plate with a hood attached to the housing for directing light downward and preventing direct view of the lamp and a lens disposed within the face plate.

The mounting sleeve is a cylinder formed from a plastic, polyvinyl-chloride (PVC) or similar material that can be installed into a wall during construction, or inserted into a bore formed in the wall post-construction. The lamp housing is cylindrical with an outer diameter adapted to closely and slidably fit within the inner diameter of the sleeve. The lamp housing can be adjusted relative to the sleeve along two axes. A first adjustment is along the axis of the sleeve, allowing the depth of the fixture to be adjusted so that the face plate abuts the outer wall surface. A second adjustment is axial rotation. The housing rotates freely within the sleeve to allow the installer to precisely set the level point of the fixture to ensure symmetrical light distribution.

In a preferred embodiment, a waterproof connection is disposed at the internal end of the housing to permit electrical connection to the socket within the housing. The socket is mounted on a slidable bracket which allows the socket to be shifted vertically along a plane running perpendicular to the axis of the housing. This adjustment allows the beam length and spread to be varied for use in different areas of illumination, i.e., in either large or small areas. The adjustment also provides means for glare control by shifting the lamp upward into a position that is fully shielded by the hood for reduced glare.

The face plate incorporates a hood, or brow, which extends outward to overhang the lens opening to keep the light source from direct view at standing eye level. The face plate has an annular flange that inserts into the open end of the housing where it is held in place by compression created by two O-rings and optional set screws. The O-rings allow the face plate to be rotated axially relative to the housing while still maintaining a water-tight housing.

In a preferred embodiment, the lens is formed from tempered glass, the upper half of which is frosted to reduce hard shadow patterns by producing diffuse light for projection onto the area directly around the fixture. The lower half of the lens is clear to provide long light projection with maximum light transmission at a lower level that is less likely to be directly visible to a pedestrian walking in the vicinity.

BRIEF DESCRIPTION OF THE DRAWINGS

The accompanying drawings, which are incorporated in and form a part of the specification, illustrate embodiments of the present invention and, together with the description, disclose the principles of the invention, wherein.

DETAILED DESCRIPTION OF THE PREFERRED EMBODIMENT

Figure 1:
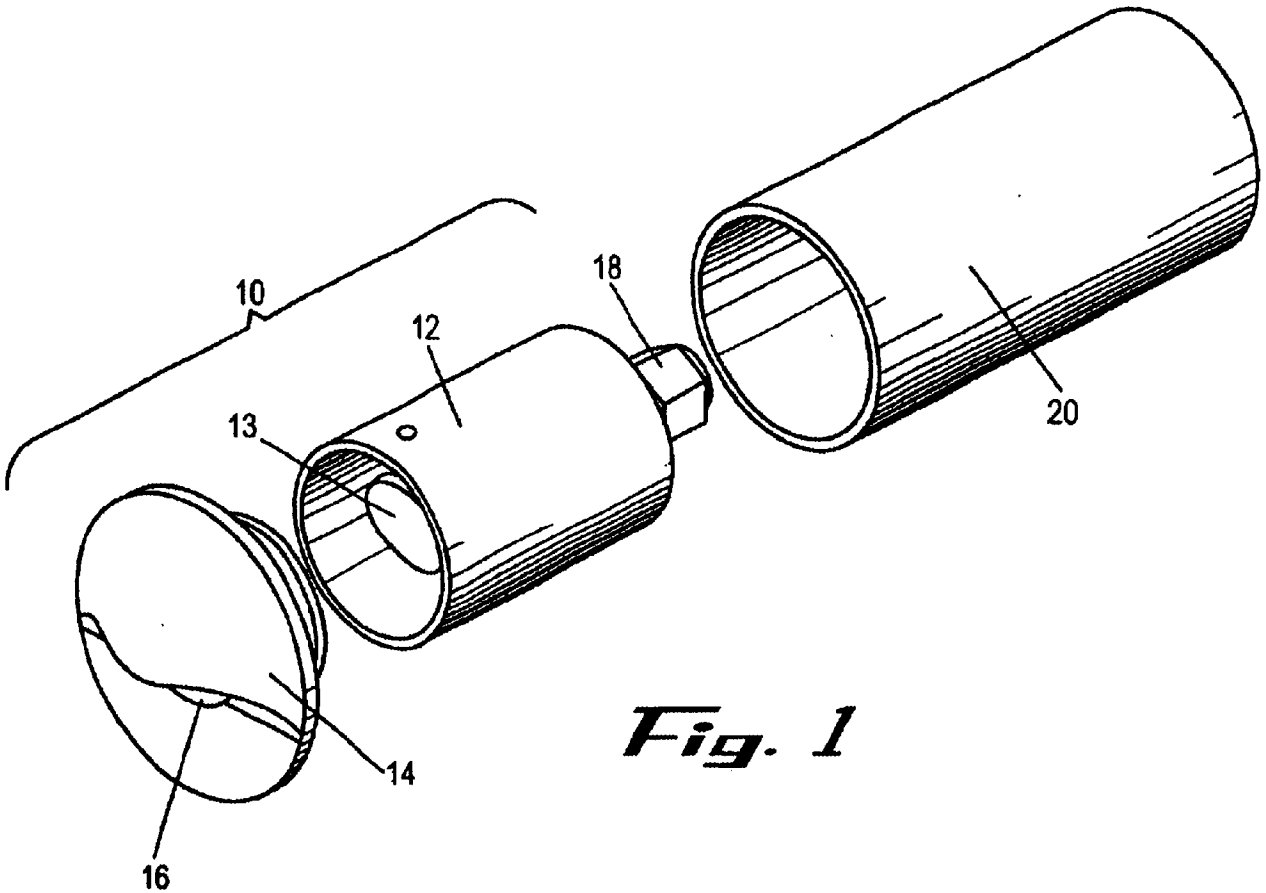
FIG. 1 is an exploded perspective view of the recessed wall-mounted light fixture with the mounting sleeve.
Figure 2:
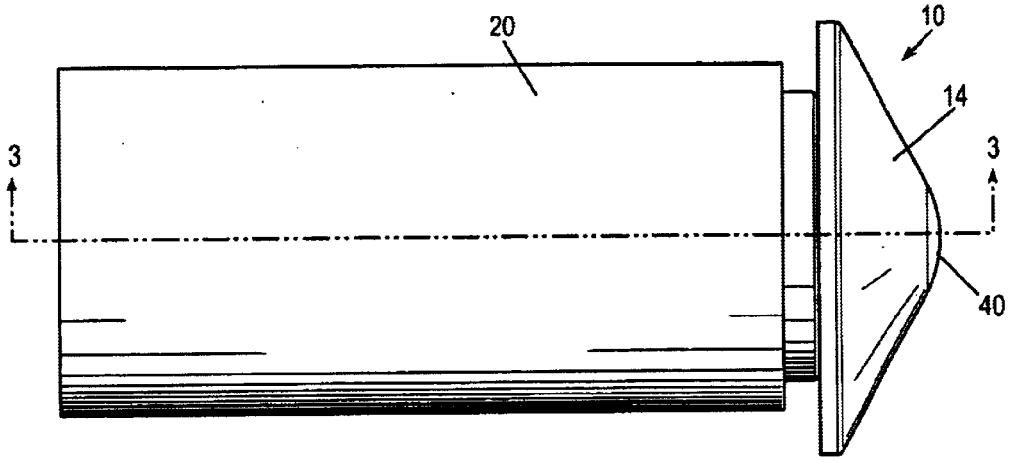
FIG. 2 is a top plan view of the light fixture with the mounting sleeve.

As shown in FIG. 1, light fixture 10 comprises a cylindrical housing 12 for retaining a light source 13 and face plate 14 for sealing the housing 12 and retaining a lens 16 through which light passes out of the fixture and onto the surface to be illuminated. Light fixture 10 is mounted in a vertical wall by sliding cylindrical housing 12 into a mounting sleeve 20 which was pre-mounted into the wall, either upon original construction or by boring an appropriate opening into an existing wall.

Mounting sleeve 20 is a plastic tube or pipe that is installed so that it extends horizontally, perpendicular to the plane of the wall surface. Preferably, sleeve 20 is PVC (polyvinylchloride) conduit or similar tubing. Conventional, commercially available PVC tubing, e.g., Schedule 40 PVC pipe, is suitable. Most preferably, the sleeve material conforms to Underwriter's Laboratory VO fire-rating, such as a fire retardant plastic or metal. Exemplary dimensions for sleeve 20 are approximately 51 mm (2 inches) I.D. (PVC Schedule 40 Nominal 2 inch) by 178 mm (7 inches) long. The diameter is selected to closely fit the exterior of housing 12 while still allowing the housing to be easily rotated and moved axially within sleeve 20. The length of sleeve 20 is selected to provide space behind the housing 12 for excess wiring or cable so that the housing can be removed from the sleeve to provide access to the connector 18 at the back of the fixture. For installation, an excess length of sleeve tubing can be installed in the wall during construction, then the portion of the tube extending beyond the wall surface can be cut flush with the wall after any coatings or finishes, e.g., stucco, have been applied.

Figure 3:
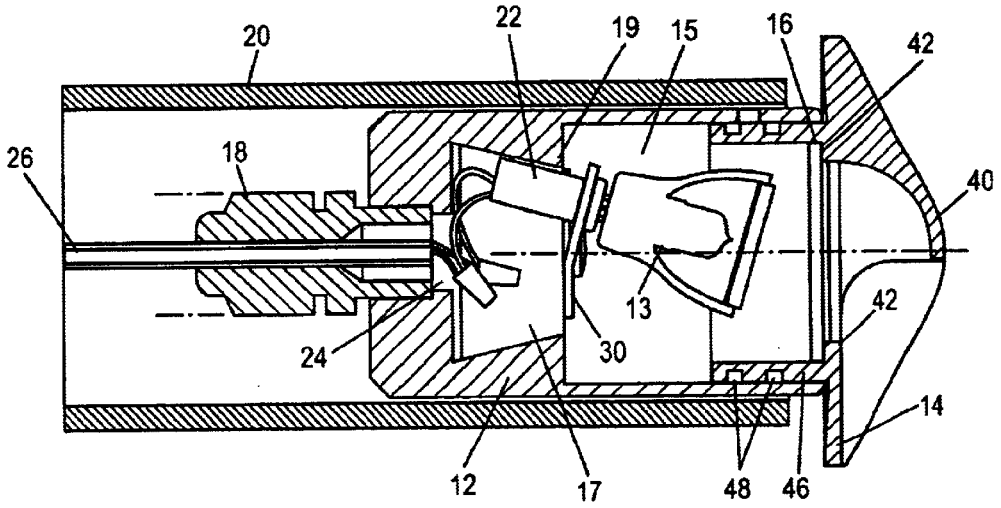
FIG. 3 is a cross-sectional view taken along line 3—3 of FIG. 2.

Housing 12 has a cylindrical body with dimensions adapted to closely fit within sleeve 20 in such a manner that allows the light fixture to be manipulated by rotation or sliding in an axial direction. An exemplary length for housing 12 is on the order of 80 mm 13.1 inches), with an outer diameter of 50 mm (2 inches). Housing 12 may be formed from metal such as brass, steel, aluminum or other appropriate metal, or from a fire resistant, heat tolerant plastic. Housing 12 has two chambers formed therein. Referring to FIG. 3, a first chamber 15, which is located in the forward portion of the housing extends approximately halfway down the length of the housing, providing a space within which lamp 13 is retained. A second chamber 17 begins at annular edge 19, extending to the rearward portion of the housing. Second chamber 17 retains the back end of the socket 22, providing sufficient room to allow the position of the socket 22 to be moved in a plane parallel to the axis of the housing 12 and provides access for connection of the socket to. electrical conductors and/or connectors. Bore 24 is formed through the back end of housing 12 is dimensioned for insertion and retention of watertight connector 18. Connector 18 can be pressed into bore 24 to create an interference fit, or preferably, bore 24 can be threaded to accept a standard threaded connector, e.g., a NPT ⅜" connector such as is available from Heyco Products (Toms River, N.J.), or similar commercially-available liquid tight connectors. Cable 26 is electrically connected to a low voltage transformer (not shown) to provide voltage for operating lamp 13.

Figure 5:
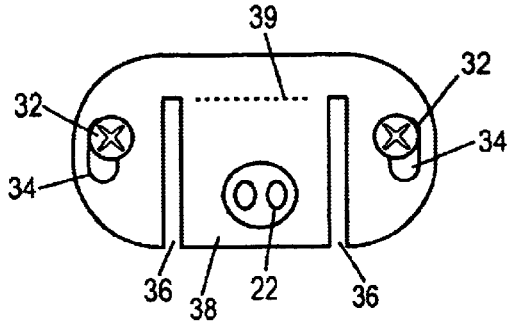
FIG. 5 is a front plan view of a bracket for adjusting socket and lamp position.

Lamp 13, shown in FIG. 3 with a built-in reflector, is a conventional halogen lamp for use in low voltage lighting systems. In the preferred embodiment, lamp 13 is a MR8 type lamp which is available from a large number lamp manufacturers. Socket 22 is a conventional plastic socket that is also commercially-available from a number of sources. For example, appropriate sockets are available from BJB of Amsberg, Germany. Socket 22 is retained by bracket 30, the details of which are illustrated in FIG. 5, which is discussed below.

Bracket 30 is adapted for attachment to edge 19 by way of one or more screws 32 which pass through a corresponding elongated slot 34 and into a threaded bore formed in edge 19. The position of the bracket 30 within the housing can be adjusted by loosening screws 32 and sliding the bracket up or down along slots 34. Once the desired location is achieved, the screws are re-tightened. Notches 36 that are cut through the bracket 30 define a bracket center section 38 which is bent along line 39 at a non-zero angle relative to the plane of edge 19. In a preferred embodiment, bracket 30 is formed from metal such as steel or aluminum and powder coated to protect against corrosion in the event moisture is able to enter the housing. Selection of other appropriate materials and coatings will be apparent to those of skill in the art. As shown in FIG. 3, the angle of bracket center section 38 causes lamp 13 to be directed outward and slightly downward. By adjusting bracket 30 upward relative to the center axis, the lamp 13 is positioned so that is covered to a greater degree by hood 40, which may be appropriate to reduce glare. Such adjustment also reduces the distance that light is projected from the fixture, directing a greater amount of light close to the fixture. This provides helps prevent glare when illuminating walkways or stairs with significant elevation changes. Adjustment of bracket 30 to a lower position relative to the center axis of the fixture causes light to be projected at a greater distance from the fixture.

Figure 4:
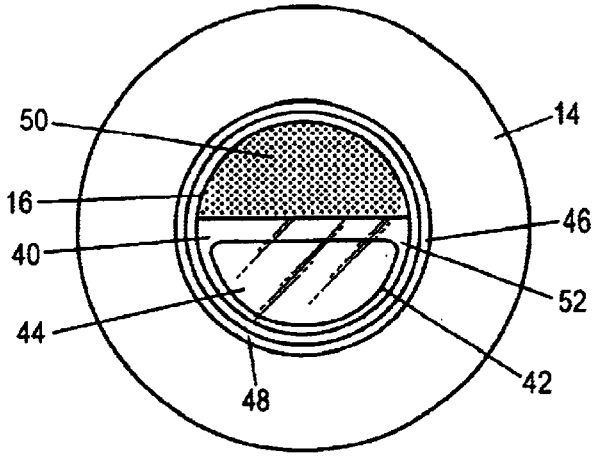
FIG. 4 is a plan view of the face plate looking from the interior of the housing outward.

Referring to FIGS. 3 and 4, face plate 14 has a hood 40 formed on the upper portion of its exterior which shields the lamp so that light does not shine upward into the eyes of a pedestrian who is passing by or walking towards the fixture. An exemplary diameter for face plate 14 that can be used in combination with previously described exemplary dimensions for housing 12 and sleeve 20 is 76 mm (3 inches). Hood 40 extends approximately halfway or more down face plate 14. On the interior of face plate 14 is formed an annular flange 46 which has an outer diameter adapted to closely fit within chamber 17. At least one O-ring seat is formed in flange 46 for retaining O-ring 48 so that, when flange 46 is inserted into chamber 17, a watertight seal is created. In the preferred embodiment that is illustrated, two O-ring seats and two O-rings 48 are provided. Face plate 14 can be rotated axially relative to housing 12 and can be detached from housing 12 by overcoming the frictional resistance created by the O-rings 48 against the inner surface of chamber 17. In a preferred embodiment, one or more set screws may be inserted into bores formed in the sidewall of housing 12 to prevent rotation of face plate 14 once the desired adjustments have been made. If additional adjustment is required, or when the lamp needs to be changed, the set screws are loosened to allow face plate 14 to be pulled away from or rotated relative to housing 12.

Although face plate 14 is illustrated with a circular shape, other shapes, such as ovals, squares, rectangles or other polygons, can be used as long as flange 46 is cylindrical in shape for insertion into housing 12. Face plate 14 may be formed from metal, preferably the same metal used to form housing 12. Examples of appropriate metals include brass, aluminum that is anodized, powder coated or otherwise treated for corrosion resistance, steel, including stainless steel, etc.

A semi-circular opening 44 is formed below hood 40 in face plate 14 to permit light to escape from housing 12. A circular lens 16 disposed within flange 46 against lip 42 covers opening 44, fully enclosing lamp 13 within housing 12. Lens 16 is attached to lip 42 using an appropriate adhesive to create a watertight seal.

Lens 16 is formed from tempered glass, quartz, or other transparent material suitable for use in light fixtures. In the preferred embodiment, the lens 16 has a bi-focal configuration. The upper portion 50 of lens 16 is treated to create a frosted surface which reduces hard shadows by scattering the light onto the area directly around the fixture.

Alternative means for diffusing light may be used and will be readily apparent to one of skill in the art. The frosted upper portion 50 of lens 16 is capable of scattering light 180° and therefore is positioned so that it is completely behind hood 40 to avoid the possibility of glare resulting from direct view. The lower portion 52 of lens 16 is clear to allow long light projection and high light transmission. Adjustment of the position of bracket 30 adjusts the relative fractions of light that are transmitted through the upper versus the lower lens surfaces.

Figure 6:
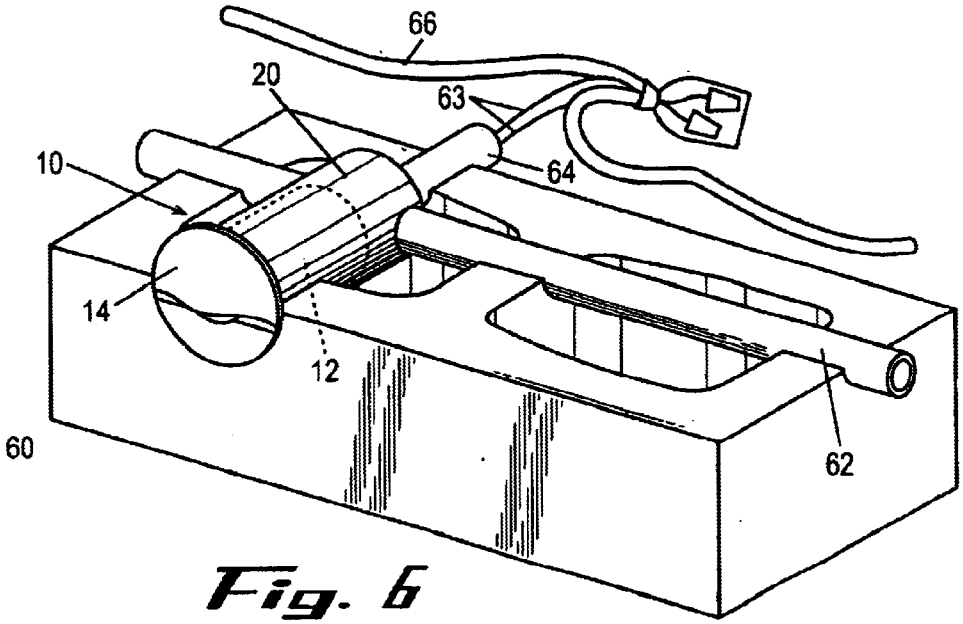
FIG. 6 is a perspective view of the light fixture and mounting sleeve positioned within a portion of a wall.

FIG. 6 illustrates a light fixture 10 according to the present invention positioned within a cinderblock 60 with optional connection schemes. The first optional connection scheme involves the formation of openings through the sides of sleeve 20 for coupling to electrical conduits 62 through which connection to a voltage source is made. The use of the plastic or PVC tube makes it quite easy to drill appropriate openings for such an installation. The second option for connection is made by feeding wires 63 out of the back end of the housing 12 and sleeve 20, through conduit 64 and out the back side of cinderblock 60 where connection is made to appropriate cable 66. Both connection schemes can be provided for during construction of the wall by positioning the sleeve and conduits. Then, after the wall is completed, the light fixture 10 can be connected to cable that is inserted into the selected conduit and adjusted as needed.

Light fixture 10 provides the installer with flexibility to optimize the illumination. The free rotation of the fixture within sleeve 20 allows the installer to precisely set the level point of the housing. This is critical to ensure symmetrical light distribution. If the fixture is adjusted to emit a narrow beam spread, the fixture can project light about 10 meters or more. If the rotational adjustment of any wall light fixture is off by even a few degrees, it can dramatically affect the light distribution over distance, thereby reducing performance. For example, on very wide stairways, this could result in dark areas which can present in a pedestrian hazard. The light fixture described herein overcomes such problems and provides several other means for optimizing the illumination produced by a wall light.

While various embodiments of this invention have been described above, these descriptions are given for purposes of illustration and explanation. Variations, changes, modifications and departures from the systems and methods disclosed above may be adopted without departure from the spirit and scope of this invention.

I claim:

1. A light fixture assembly for recessed installation in a wall, the assembly comprising:

a cylindrical tube for mounting in an opening in the wall, the tube having an inner diameter;

a cylindrical housing having an axis, a substantially closed rear portion, an open front portion, and an outer diameter adapted to slide along the axis and rotate around the axis within the tube, wherein the housing has a first chamber adjacent the open front portion, and wherein a bore is formed through the rear portion;

a lamp disposed within the first chamber so that the lamp is fully recessed within the cylindrical housing;

a socket for retaining and providing voltage to the lamp, wherein the socket is mounted at a rear portion of the first chamber;

a connector adapted for insertion into the bore formed in the rear portion for providing an electrical connection from the socket to an electrical cable disposed outside of the housing;

a face plate having a hood and an opening below the hood through which light from the lamp is transmitted, the face plate having an annular flange extending from an inner face adapted to closely fit within the first chamber of the housing; and a lens mounted in the face plate to cover the opening;

wherein light distribution from the light fixture is adjustable by sliding and rotating the housing relative to the tube.

2. The light fixture assembly of claim 1, further comprising a bracket at the rear portion of the first chamber for mounting the socket and at least one screw for retaining the bracket at the rear portion of the first chamber, wherein the bracket has at least one slot for receiving the at least one screw, the at least one slot being elongated to permit sliding of the bracket relative to the screw.

3. The light fixture assembly of claim 2, wherein the at least one slot is vertically oriented so that the position of the socket and lamp within the housing can be raised or lowered.

4. The light fixture assembly of claim 2, wherein the bracket has a center portion that is bent at an angle to direct a beam emitted from the lamp downward.

5. The light fixture assembly of claim 1, wherein the connector is a water tight connector.

6. The light fixture assembly of claim 1, wherein the lens has an upper section and a lower section, wherein the upper section is adapted to diffuse light and the lower section is transparent for substantially complete light transmission.

7. The light fixture assembly of claim 6, further comprising a bracket at the rear portion of the first chamber for mounting the socket and at least one screw for retaining the bracket at the rear portion of the first chamber, wherein the bracket is slidably mounted for raising or lowering the socket and lamp to adjust a relative percentage of light passing through the upper and lower sections of the lens.

8. The light fixture assembly of claim 1, wherein the annular flange of the face plate has at least one O-ring seat formed therein and further comprising an O-ring disposed within the at least one O-ring seat.

9. The light fixture assembly of claim 1, wherein the cylindrical tube comprises a PVC pipe.

10. The light fixture assembly of claim 1, wherein the housing and face plate are formed from brass.

11. A light fixture adapted for recessed mounting in a wall, the light fixture comprising:

a cylindrical housing having an axis, a substantially closed rear portion, an open front portion, and an outer diameter adapted to slide alone the axis and rotate around the axis within the tube, wherein the housing has a first chamber adjacent the open front portion, and wherein a bore is formed through the rear portion;

a lamp disposed within the first chamber so that the lamp is fully recessed within the cylindrical housing;

a socket for retaining and providing voltage to the lamp, wherein the socket is mounted at a rear portion of the first chamber;

a connector adapted for insertion into the bore formed in the rear portion for providing an electrical connection from the socket to an electrical cable disposed outside of the housing;

a face plate having a hood and an opening below the hood through which light from the lamp is transmitted, the face plate having an annular flange extending from an inner face adapted to closely fit within the first chamber of the housing;

a lens mounted in the face plate to cover the opening; and a tube disposed in the wall in a horizontal direction, the tube having an inner diameter larger than the outer diameter of the housing so that the housing can be inserted into and retained by the tube;

wherein light distribution from the light fixture is adjustable by sliding and rotating the housing relative to the tube.

12. The light fixture of claim 11, further comprising a bracket disposed at the rear portion of the first chamber for mounting the socket and at least one screw for retaining the bracket at the rear portion of the first chamber, wherein the bracket has at least one slot for receiving the at least one screw, the at least one slot being elongated to permit sliding of the bracket relative to the screw.

13. The light fixture of claim 12, wherein the at least one slot is vertically oriented so that the position of the socket and lamp within the housing can be raised or lowered.

14. The light fixture of claim 12, wherein the bracket has a center portion that is bent at an angle to direct a beam emitted from the lamp downward.

15. The light fixture of claim 11, wherein the connector is a water tight connector.

16. The light fixture of claim 11, wherein the lens has an upper section and a lower section, wherein the upper section is adapted to diffuse light and the lower section is transparent for substantially complete light transmission.

17. The light fixture of claim 16, further comprising a bracket at the rear portion of the first chamber for mounting the socket and at least one screw for retaining the bracket at the rear portion of the first chamber, wherein the bracket is slidably mounted for raising or lowering the socket and lamp to adjust a relative percentage of light passing through the upper and lower sections of the lens.

18. The light fixture of claim 11, wherein the annular flange of the face plate has at least one O-ring seat formed therein and further comprising an O-ring disposed within the at least one O-ring seat.

19. The light fixture of claim 11, wherein the cylindrical tube comprises a PVC pipe.

20. The light fixture of claim 11, wherein the housing and face plate are formed from brass.

21. A recessed, wall-mounted light comprising:

a cylindrical housing having a substantially closed rear portion, an open front portion, and an outer diameter, wherein the housing has a first chamber with an inner diameter adjacent the open front portion, and wherein a bore is formed through the rear portion;

a lamp disposed within the first chamber so that the lamp is fully recessed within the cylindrical housing;

a socket for retaining and providing voltage to the lamp;

a bracket for retaining the socket, the bracket having at least one slot for receiving a screw for mounting at a rear portion of the first chamber, the at least one slot being elongated to permit sliding of the bracket relative to the screw to move the lamp and socket upward or downward, the bracket further having an angled center section for retaining the socket and lamp at a downward-facing angle;

a connector adapted for insertion into the bore formed in the rear portion for providing an electrical connection from the socket to an electrical cable disposed outside of the housing;

a face plate having a hood and an opening below the hood through which light from the lamp is transmitted, the face plate having an annular flange extending from an inner face adapted to closely fit within the inner diameter of the first chamber, the annular flange having at least one O-ring seat formed therein;

an O-ring disposed in the at least one O-ring seat for creating a close fit to the inner diameter of the first chamber a lens mounted in the face plate to cover the opening, the lens having an upper section adapted for diffusing light and a lower section for transmitting light, wherein assembly of the housing, connector, face plate and lens creates a watertight seal; and a tube disposed in the wall in a horizontal direction, the tube having an inner diameter larger than the outer diameter of the housing so that the housing can be slidably and rotatably inserted into and retained by the tube;

wherein light distribution from the light fixture and an angular orientation of the face plate are adjustable by sliding and rotating the housing relative to the tube.

* * * * *